US012710059B2

(12) United States Patent
Kaiser et al.

(10) Patent No.: US 12,710,059 B2
(45) Date of Patent: Aug. 18, 2026

(54) DETUNING DEVICE AND METHOD

(71) Applicant: SULZER MANAGEMENT AG, Winterthur (CH)

(72) Inventors: Thomas Francis Kaiser, Chimacum, WA (US); Pharic Smith, Strathaven (GB)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 19/278,836

(22) Filed: Jul. 24, 2025

(65) Prior Publication Data

US 2026/0043420 A1 Feb. 12, 2026

Related U.S. Application Data

(60) Provisional application No. 63/680,460, filed on Aug. 7, 2024.

(30) Foreign Application Priority Data

Aug. 22, 2024 (EP) ..... 24195975

(51) Int. Cl.
*F04D 29/66* (2006.01)

(52) U.S. Cl.
CPC ..... *F04D 29/664* (2013.01)

(58) Field of Classification Search
CPC ..... F04D 29/664
See application file for complete search history.

(56) References Cited

U.S. PATENT DOCUMENTS 4,318,283 A * 3/1982 Windish ..... F16D 3/14 192/214.1
2019/0242408 A1* 8/2019 Sishtla ..... F04D 29/664

FOREIGN PATENT DOCUMENTS

| | | | | |
|---|---|---|---|---|
| DE | 74 20 758 U | | 1/1975 | |
| GB | 2113346 A | * | 8/1983 | ..... E04B 1/8409 |
| GB | 2269880 A | * | 2/1994 | ..... F16F 13/02 |
| JP | S54-19302 U | | 2/1979 | |
| JP | 2010174637 A | * | 8/2010 | |

OTHER PUBLICATIONS

English Translation of JP 2010174634, Nagai et al. (Jan. 27, 2009) (Year: 2025).*
Extended European Search Report received for EP Application No. 24195975.8, mailed on Feb. 20, 2025, 9 pages.

* cited by examiner

*Primary Examiner* — Nathaniel E Wiehe
*Assistant Examiner* — Aye S Htay
(74) *Attorney, Agent, or Firm* — Spencer Fane, LLP

(57) ABSTRACT

A detuning ring includes first and second axial faces, and is for detuning a structural resonance in a pump assembly. The first axial face includes first lands and first grooves, each first land extending in a radial direction and including a planar first top face, and each first groove delimited by two adjacent first lands and the first axial face. The second axial face includes second lands and second grooves, each second land extending in the radial direction and including a planar second top face, each second groove delimited by two adjacent second lands and the second axial face. The detuning ring is to be arranged between the drive unit and the hydraulic unit of the pump assembly, and is to be fixed relative to the drive unit or the hydraulic unit.

15 Claims, 9 Drawing Sheets

DETUNING DEVICE AND METHOD

CROSS-REFERENCE TO RELATED APPLICATION

This application claims priority to European Application No. 24195975.8, filed on Aug. 22, 2024, and U.S. Application No. 63/680,460, filed on Aug. 7, 2024, the contents of each of which are hereby incorporated by reference.

TECHNICAL FIELD

The disclosure relates to a device and a method for reducing vibrations in vertical pump assemblies, according to the preambles of the independent claims.

BACKGROUND

Vertical pumps are fluid-handling machines wherein a pump shaft is oriented in direction of gravity during operation. This pump type is used in many industries, including power generation, fresh water and wastewater transport, irrigation, chemical processing, oil and gas production and refining, hot water extraction from geothermal wells, cooling, and many more, often where a net positive suction head is required. While the term vertical pump includes a multitude of variants, such as turbine or centrifugal types, lift or in-line arrangements, single- or multi-stage versions, and configurations for a broad range of applications, all configurations profit from the advantage of extraordinary space efficiency through minimization of the horizontal footprint, provided by their vertical orientation.

Irrespective of the type or use, a typical vertical pump assembly comprises a drive unit such as an electric motor, a hydraulic unit including a housing and at least one impeller, and a pump shaft connecting the drive unit with the at least one impeller. The drive unit is typically either bolted directly to the hydraulic unit, or to an intermediate unit between the drive and hydraulic unit. This intermediate unit, often acting as a driver stand, provides space for additional components, and enables optimal design of a discharge-head, which is often located at the upper end of the hydraulic unit and provides a fluid connection of the pump assembly to the piping of a greater system. Herein, the driver stand can either be mounted on top of the discharge-head or integrated with it, while the discharge-head either comprises just the discharge piping as in wet pit pumps, or a combination of the suction and discharge piping as in so-called double casing pumps. The discharge-head can be attached to a foundation or to a support structure via a baseplate. In an example of a wet pit pump, the drive unit, the intermediate unit, i.e., the driver stand, the discharge-head, and the baseplate constitute the above-grade or above-ground portion of a vertical pump assembly, while the below-grade or below-ground structure of the pump comprises columns with flanges on either side, connected to bowls, and a suction bell at the very bottom.

The arrangement of other pump types can deviate, however, the drive unit, hydraulic unit, optional intermediate unit, and pump shaft, which connects the drive unit to at least one impeller in the hydraulic unit, can be regarded as universal parts of any vertical pump. Therein, depending on its length, the pump shaft can consist of multiple elements connected in series by rigid or flexible couplings.

SUMMARY

During operation of a vertical pump assembly, the drive unit can exert a torque on the pump shaft to create a rotation of the at least one impeller mounted to the pump shaft, in turn providing the energy for the pumped fluid to be accelerated. The rotation can be imposed by the drive unit at a fixed speed or over a range of speeds using a variable frequency drive.

Owing to their construction, vertical pumps typically exhibit relatively low stiffness structures, resulting in their lowest structural natural frequencies at or near the relevant excitation frequencies, which can potentially lead to structural resonance conditions and correspondingly amplified structural vibration levels. These amplified vibrations can breach compliance standards and even trigger equipment failure due to fatigue, component wear, or unexpected contact between rotating and stationary parts. Even though such conditions can also occur in vertical pump assemblies with fixed speed drives, they are particularly difficult to avoid in vertical pump assemblies with variable frequency drives. Further, such conditions can occur within above-grade, below-grade, or combined above and below grade structural modes.

The severity of a resonance condition depends on multiple factors, including a) the magnitude of the excitation forces acting on the system, b) the frequency separation between the excitation source and the affected structural modes, c) the amount of modal damping present to dissipate a portion of the vibration energy, d) the transfer function between the excitation force and the system response, and e) the structural robustness of the system.

For most industries, proper handling of structural resonance induced vibration issues of vertical pump assemblies is critical and a multitude of mitigation strategies were developed, today being considered common industry knowledge.

Whereas significant effort and progress was made in analytically predicting potential structural resonance conditions during the development or design phase of a vertical pump, four widely used methods have emerged as effective corrective actions to alleviating at least part of the detrimental resonance conditions, as detailed below.

First, a reduction of excitation energy can be achieved by improving the balance of rotating components which leads to a proportionally reduced magnitude of resonance induced amplified structural vibration levels. However, any rotating equipment will exhibit a certain level of residual unbalance, which can be sufficient to cause a resonance induced vibration issue.

Second, a structural resonance condition can be resolved by detuning, i.e., by changing the natural frequencies of relevant structural modes. This detuning can on one hand be achieved by increasing the system stiffness or by reducing the system mass, which leads to an increase of the structural natural frequencies. On the other hand, decreasing the system stiffness or increasing the system mass leads to a decrease of structural natural frequencies. However, decreasing the system stiffness or decreasing the mass can result in an unstable structure, which might be prone to buckling, only leaving an increase of the system mass or an increase the system stiffness as viable detuning options.

Increasing the system mass can be achieved, for example, by attaching detuning weights to a driver frame, however, the amount of detuning mass required for even a small change in natural frequency can be large, and adaption to variable frequency operated units might be difficult.

Increasing system stiffness can be achieved for example by welding stiffening ribs to the assembly, which can lead to significant detuning, rendering it a good detuning method for vertical pump assemblies operated at fixed speed. Nevertheless, the achievable detuning is typically not sufficient for vertical pump assemblies operated with variable frequency drives and welding and the corresponding post weld heat treatment of the affected components often results in considerable additional cost and prolonged lead-time for procurement and down time for implementation.

Third, detuning of structural natural frequencies and the excitation frequencies can be achieved by application of passive dynamic absorbers which typically compromise a spring, a damper, and mass components. A passive dynamic absorber is tuned to a natural frequency of the vertical pump and fixed to the existing above-grade structure, which eliminates the targeted natural frequency, yet creates two new structural natural frequencies one below and one above the original one. Even though this solution can be effective for detuning resonance conditions of vertical pumps with fixed speed drives and variable frequency drives, it generally renders expensive and requires tuning of the passive dynamic absorbers on site. Furthermore, since passive dynamic absorbers vibrate during operation to eliminate structural natural frequencies, material aging and degradation can lead to unstable operation over time, requiring regular maintenance or spare part replacement with lifetimes or maintenance cycles often rendering significantly shorter than the lifetime or maintenance cycle of the corresponding vertical pump.

Forth, vibration absorbing material can be used to reduce some of the adverse effects of resonance induced amplified structural vibrations. A common approach includes placement of vibration absorbing mats or pads between the pump assembly and its support structure, whereas a less common approach is to separate individual components of the pump assembly with vibration absorbing material. Both strategies are however primarily applied to isolate vibrating equipment from its environment and not to resolve structural resonance conditions.

In summary, apart from simply damping vibrations, three major corrective methods have emerged to address structural resonance conditions in vertical pump assemblies, including reducing excitation energy by balancing rotating components, detuning structural natural frequencies by adjusting system stiffness or mass, and using passive dynamic absorbers. While balancing and detuning can be effective, they each have limitations such as residual unbalance, potential instability, high costs, and prolonged lead-times and down times. Passive dynamic absorbers, though effective, are expensive and require regular maintenance due to material aging and degradation.

Starting from this state of the art, it is therefore an object of the disclosure to propose an effective and cost-efficient device and method for detuning of resonance conditions of vertical pump assemblies, suitable for use with fixed speed drives and variable frequency drives, and further suitable for new equipment and retrofitting of existing equipment, without impairing but rather increasing the reliability or lifetime of a vertical pump assembly.

The subject matter of the disclosure satisfying this object is characterized by the features disclosed herein.

Thus, according to the disclosure a detuning ring for detuning a structural resonance in a pump assembly is proposed, wherein the pump assembly comprises a drive unit and a hydraulic unit, wherein the detuning ring is configured for being arranged between the drive unit and the hydraulic unit, wherein the detuning ring is further configured for being fixed relative to the drive unit or the hydraulic unit, wherein the detuning ring comprises a first axial face and a second axial face, wherein the first axial face is configured with a plurality of first lands, wherein each first land extends in radial direction and comprises a planar first top face, wherein a plurality of first grooves is provided, wherein each first groove is delimited by two adjacent first lands and the first axial face, wherein the second axial face is configured with a plurality of second lands, wherein each second land extends in radial direction and comprises a planar second top face, wherein a plurality of second grooves is provided, wherein each second groove is delimited by two adjacent second lands and the second axial face. As such a detuning ring reduces the overall stiffness of the above-grade structure of a vertical pump assembly without impairing its structural stability, particularly enabled by the grooved structure, it allows for detuning of a resonance condition of a vertical pump assembly in an efficient and reliable manner.

In a preferred embodiment, the first grooves and the second grooves are arranged such that each first groove overlaps with two adjacent second grooves in circumferential direction. In other words, this arrangement entails that the first lands and the second lands are not overlapping in circumferential direction, creating a detuning ring structure, where the first lands and the second lands are arranged alternating on the first axial face and the second axial face. This configuration allows for minimized material and space use while maximizing the detuning efficiency.

Further, one preferred configuration is that at least one of the first lands or at least one of the second lands is provided with an axially extending through hole or tapped hole for receiving a fixing element, wherein the through hole or tapped hole extends from the first top planar face or the second top planar face. Herein, a through hole is considered as a hole without threading, featuring a smooth inner surface and provided for receiving a fixing element, wherein the fixing element such as a bolt, a screw, or a threaded rod, is used for fixing the detuning ring relative to the drive unit or the hydraulic unit. In contrast a tapped hole is considered as a hole with threading, which can be machined as a blind bore with threading or as a through hole with threading, provided for receiving a fixing element with threading, wherein the fixing element such as a screw, or a threaded rod, is used for fixing the detuning ring relative to the drive unit or the hydraulic unit. A particularly advantageous configuration is to provide a first set of fixing elements and a second set of fixing elements, each set comprising at least one fixing element, wherein the first set of fixing elements engages with at least one of the first lands and the second set of fixing elements engages with at least one of the second lands. In another preferred configuration, the first set of fixing elements and the second set of fixing elements do not fix the detuning ring to the same unit of the vertical pump arrangement, wherein the first set of fixing elements either fixes the detuning ring relative to the drive unit, or the hydraulic unit, but not to both, whereas the second set of fixing elements either fixes the detuning ring to the hydraulic unit, or the drive unit, but not to both. Consequently, this configuration leads to an increased alteration of the stiffness of the overall structure and thus increased detuning performance of the detuning ring. Another advantage of this configuration is that deformation or deflection of the detuning ring during the installation process, for example when tightening the first set of fixing elements or the second set of fixing elements, is minimized.

Further, according to the disclosure, a preferred embodiment of the detuning ring comprises at least two separate segments, abutting in circumferential direction. This contributes to the ease installation in a vertical pump assembly, for example during retrofitting of such a detuning ring in an existing assembly. In addition, considering that the detuning ring has an axial direction, a first radial direction and a second radial direction, wherein the first and the second radial direction are perpendicular to the axial direction, the segmentation of the detuning ring enables different detuning in the first and second radial direction, which can be particularly advantageous for vertical pump assemblies exhibiting different above-grade structural natural frequencies in different directions.

In another preferred embodiment of the detuning ring, the first plurality of grooves or the second plurality of grooves is closed in axial direction to form a plurality of slots. Herein, grooves are open spaces delimited by three faces, such as two faces of adjacent first lands and the first axial face. In contrast a slot is delimited by four faces, such as two faces of adjacent second lands, the second axial face, and another additional face to close the groove.

Further, a preferred configuration is that at least one slot or at least one groove is filled with a vibration absorbing material, which provides additional damping to the vertical pump assembly by absorption of a portion of any residual vibration energy. More preferably, the vibration absorbing material has high damping capabilities and low stiffness as to not contributing to the overall detuning ring stiffness in a significant way. In this configuration, providing slots instead of grooves, or slots and grooves, is advantageous for fixing the vibration absorbing material in the detuning ring by press fitting. Naturally, any other method for fixing the vibration absorbing material in the detuning ring, such as gluing, sintering, welding, screwing, riveting, bolting, clamping, soldering, or any type of bonding method is eligible as well.

Further, according to the disclosure, a vertical pump assembly is proposed, comprising a drive unit, a hydraulic unit with at least one impeller for rotating about an axial direction, a shaft connecting the drive unit with the at least one impeller, and a detuning device, wherein the detuning device is fixedly connected to the vertical pump assembly, wherein the detuning device comprises a detuning ring, wherein the detuning ring is arranged to surround a shaft. This arrangement ensures that the vertical pump assembly is detuned and exhibits minimal resonance conditions, while maintaining a small footprint and low investment and maintenance cost.

In a preferred embodiment of the vertical pump assembly, the detuning ring is arranged between two flanges, which are arranged axially adjacent to each other. In addition, a preferred configuration is that the outer diameter of the detuning ring approximately matches the outer diameter of the adjacent flanges.

In another preferred embodiment of the vertical pump assembly, the detuning ring is arranged between the drive unit and the hydraulic unit.

Alternatively, a preferred configuration of the vertical pump assembly comprises an intermediate unit which is arranged between the drive unit and the hydraulic unit for providing space for additional components and structural stability, wherein the detuning ring is arranged between the drive unit and the intermediate unit. Such an intermediate unit typically comprises a structure for connecting the housing of the hydraulic unit and the housing of the drive unit in a torque proof manner, often referred to as a driver stand, wherein the intermediate unit provides space for example for mechanical coupling of a shaft of the drive unit and the pump shaft or additional mechanical seals.

Another advantageous embodiment of a vertical pump assembly according to the disclosure is proposed such that an intermediate unit is arranged between the drive unit and the hydraulic unit for providing space for additional components and structural stability, wherein the detuning ring is arranged between the intermediate unit and the hydraulic unit.

Further, a preferred vertical pump assembly comprises a hydraulic unit in fluid communication with a discharge-head, which is arranged between the drive unit and the hydraulic unit and configured to be mounted to a base plate, wherein the detuning ring is arranged between the discharge-head and the base plate.

In addition, according to the disclosure, a method is proposed for shifting a natural frequency of a vertical pump assembly, which comprises a drive unit, a hydraulic unit with at least one impeller for rotating about an axial direction, and a shaft connecting the drive unit with the at least one impeller, the method comprising the step of arranging a detuning ring according to the disclosure between the drive unit and the hydraulic unit.

Preferably, this method is comprising the step of arranging vibration absorbing material within at least one slot or one groove of the detuning ring.

Further advantageous measures and embodiments of the disclosure will become apparent from the dependent claims.

BRIEF DESCRIPTION OF THE DRAWINGS

The disclosure will be explained in more detail hereinafter with reference to embodiments of the disclosure and with reference to the drawings.

In the drawings is shown.

DETAILED DESCRIPTION

Figure 1:
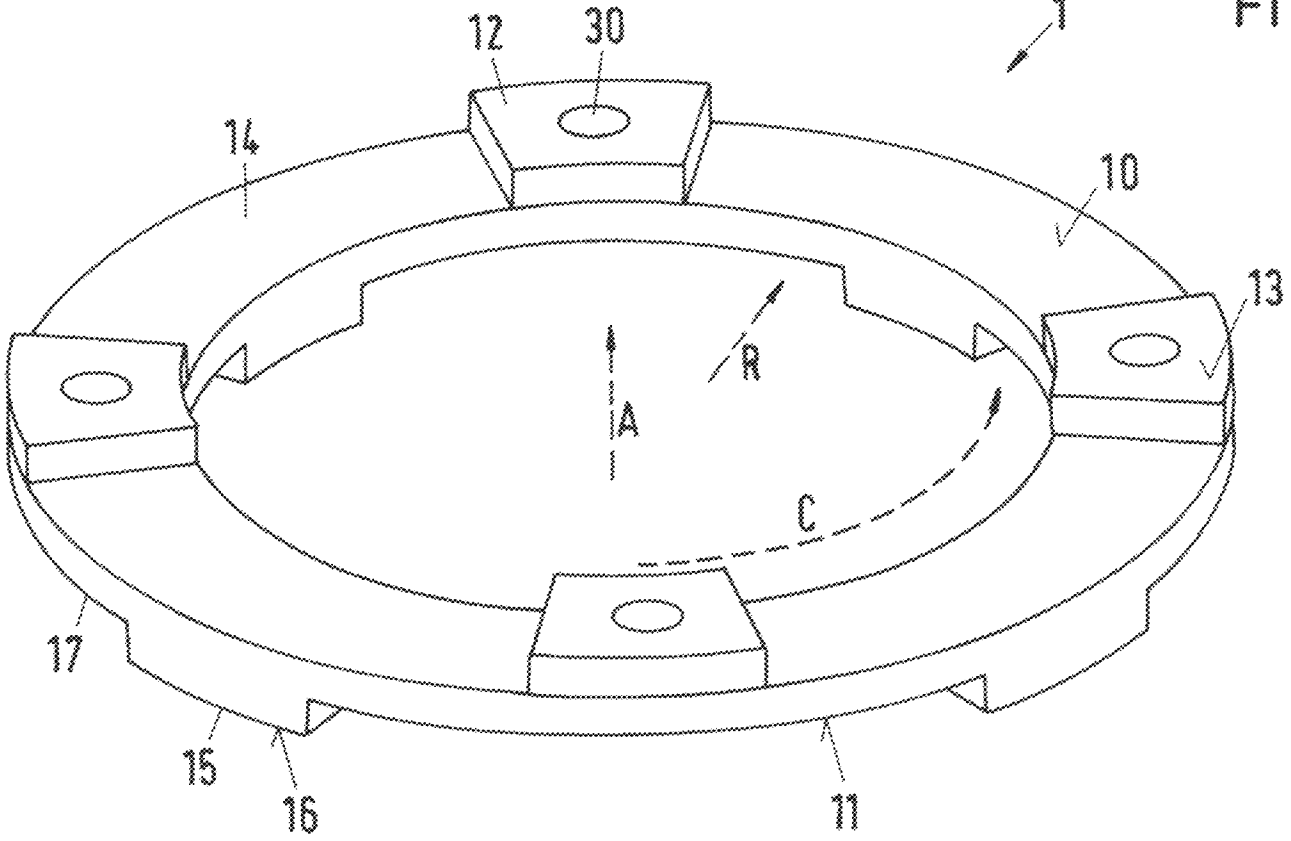
FIG. 1 is a schematic perspective view of a first embodiment of a detuning ring according to the disclosure.
Figure 2:
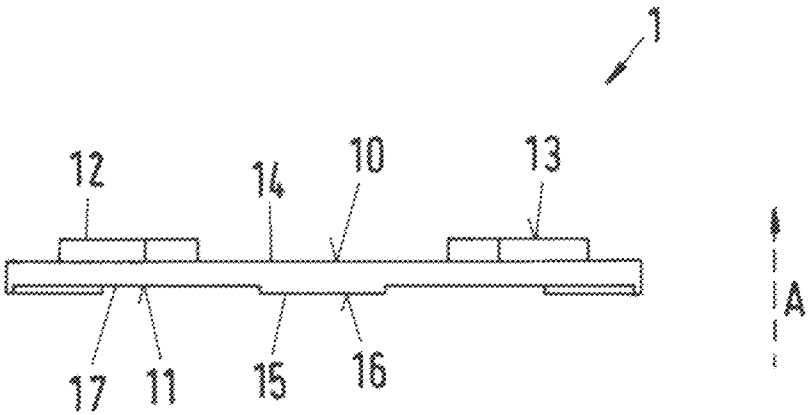
FIG. 2 is a schematic side view of the first embodiment of a detuning ring according to the disclosure, FIGS. 3A and 3B area schematic top (left) and bottom (right) view of the first embodiment of a detuning ring according to the disclosure.
Figure 3B:
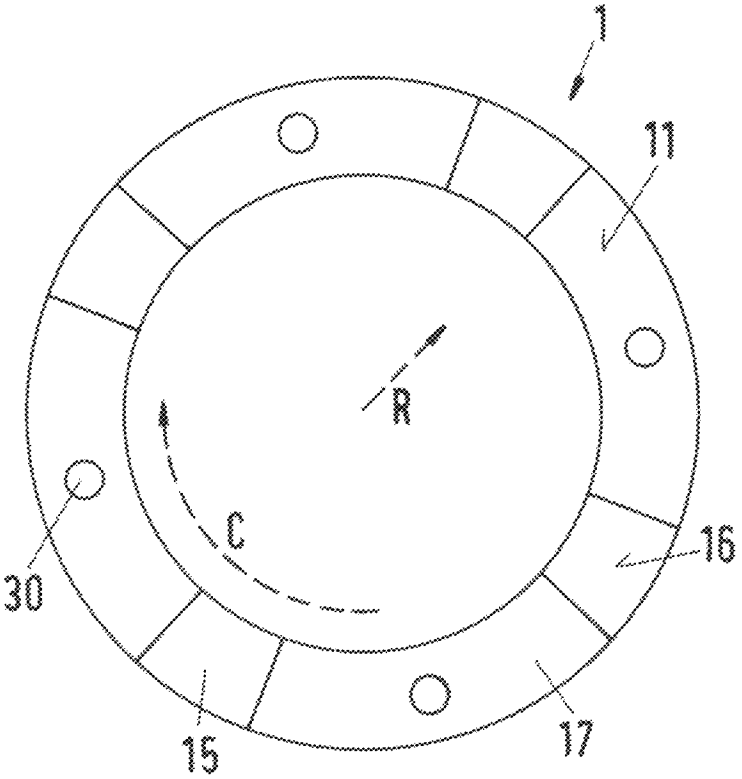
Figure 3A:
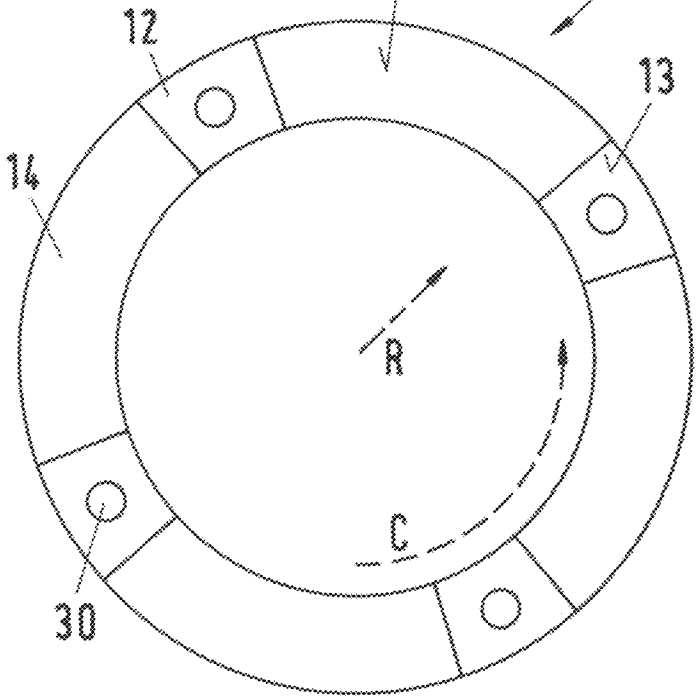

A first embodiment of a detuning ring according to the disclosure is shown in FIG. 1, FIG. 2, FIGS. 3A and 3B, wherein the detuning ring is designated in its entirety by the reference numeral 1. The center axis of the detuning ring 1 defines the axial direction A, and a radial axis which is perpendicular to the center axis, defines a radial direction R, while the circumferential direction C is defined in mathematically positive, i.e., counterclockwise direction with respect to the axial direction A. In this embodiment, the detuning ring 1 comprises a first axial face 10 and a second axial face 11, wherein the first axial face 10 is configured with a plurality of first lands 12, wherein each first land 12 comprises a planar first top face 13, wherein a plurality of first grooves 14 is provided, wherein each first groove 14 is delimited by two adjacent first lands 12 and the first axial face 10. Further, in this embodiment, the second axial face 11 is configured with a plurality of second lands 15, wherein each second land 15 comprises a planar second top face 16, wherein a plurality of second grooves 17 is provided, wherein each second groove 17 is delimited by two adjacent second lands 15 and the second axial face 11. While the lands 12 and 15 in this embodiment are equally sized, the extension of a land 12 or 15 in the axial direction A, the radial direction R, and the circumferential direction C can be adapted to any size without impairing the functionality of the disclosure, instead, certain geometries can be beneficial in specific pump assembly arrangements.

Further, the first embodiment of a detuning ring according to the disclosure shows an arrangement, wherein the first grooves 14 and the second grooves 17 are arranged such that each first groove 14 overlaps with two adjacent second grooves 17 in circumferential direction C. In this embodiment, each of the first lands 12 is provided with an axially extending through hole 30 for receiving a fixing element, wherein the through hole 30 extends from the first top planar face 12, while the second lands are free of through holes 30. Notably, in other embodiments of the detuning ring according to the disclosure, any number of first lands 12 or second lands 15 can comprise a through hole.

Figure 4B:
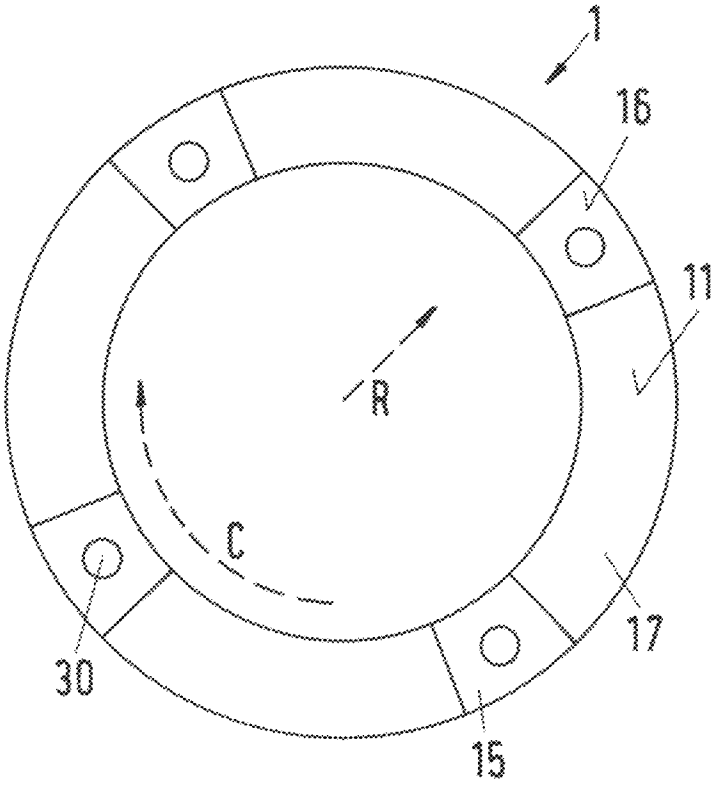
FIGS. 4A and 4B are a schematic top (left) and bottom (right) view of a second embodiment of a detuning ring according to the disclosure.
Figure 4A:
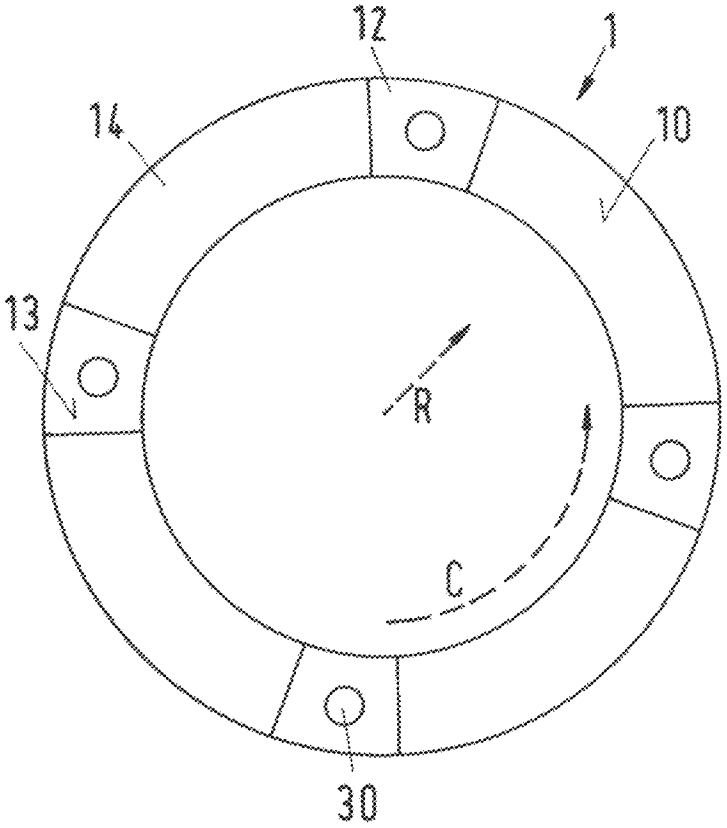

In a second preferred embodiment of the detuning ring according to the disclosure, as shown in FIGS. 4A and 4B, each of the first lands 12 and each of the second lands 15 are provided with a tapped hole 30 for receiving a fixing element, wherein the tapped hole 30 extends from the first top planar face or the second top planar face. Notably, other embodiments are possible, where only a selection of first lands or second lands comprises tapped holes, through holes, or a combination thereof. When a combination of first lands 12 and second lands 15 comprise through holes or tapped holes 30, a particularly advantageous configuration is to provide a first set of fixing elements and a second set of fixing elements, wherein each set comprises at least one fixing element, wherein the first set of fixing elements engages with at least one of the first lands 12 and the second set of fixing elements engages with at least one of the second lands 15. Notably, in other embodiments of the detuning ring according to the disclosure, any number of first lands 12 or second lands 15 can comprise a tapped hole.

Figure 5:
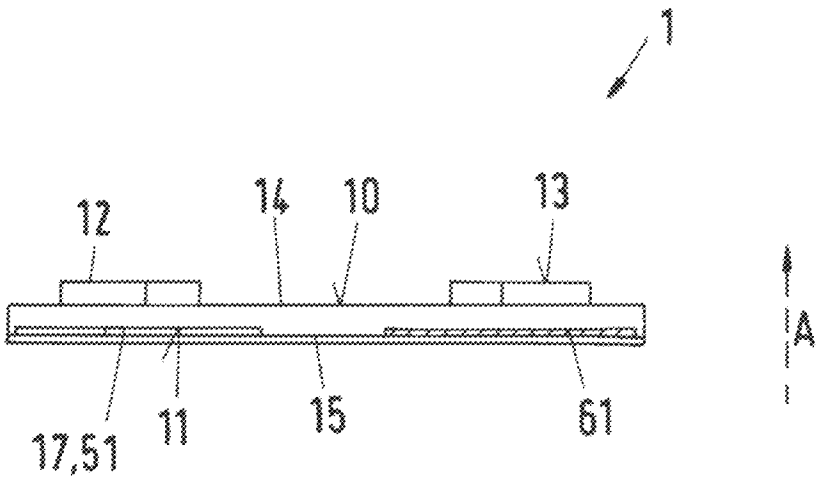
FIG. 5 is a schematic side view of a third embodiment of a detuning ring according to the disclosure.

A third preferred embodiment of the detuning ring 1 is illustrated in FIG. 5, wherein the second plurality of grooves 17 is configured to form a plurality of slots 51, by the second plurality of grooves 17 being closed in axial direction. It must be noted that in other embodiments, instead of closing the second plurality of grooves 17 in axial direction to form a plurality of slots 51, alternatively, the first plurality of grooves 14, or optionally, the first plurality of grooves 14 and the second plurality of grooves 17, can also be closed to form a plurality of slots 51.

Further, an advantageous configuration of the detuning ring 1 is that the detuning ring 1 optionally comprises at least one slot 51 or one groove 14, 17 which is filled with a vibration absorbing material 61. The third embodiment of the detuning ring according to the disclosure as shown in FIG. 5, comprises one slot 51 is filled with a vibration absorbing material 61. Notably, this is only one of many configurations with different degree of filling with vibration absorbing material 61. Alternatively, also grooves 14, 17 can be filled with vibration absorbing material 61. Irrespective of how many slots 51 or grooves 14, 17 are filled with a vibration absorbing material 61, the type of the vibration absorbing material 61 can be the same for all pieces of vibration absorbing material 61, or differing, selected based on the required amount of damping needed.

Another embodiment of a detuning ring according to the disclosure comprises preferably at least two separate segments, abutting in circumferential direction C.

Figure 6:
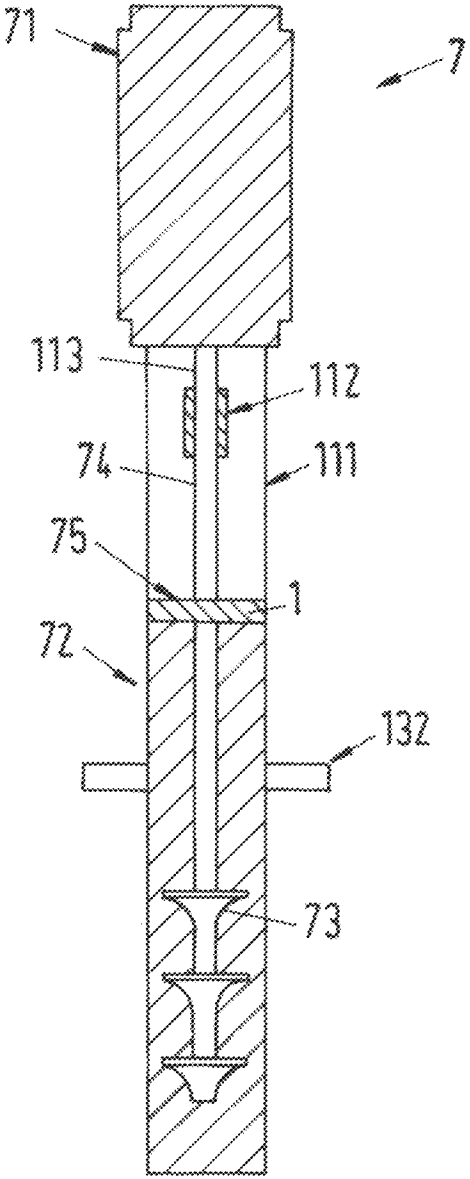
FIG. 6 is a schematic illustration of a first embodiment of a vertical pump assembly according to the disclosure.

FIG. 6 shows an embodiment of a vertical pump assembly 7, wherein the vertical pump assembly 7 comprises a drive unit 71, a hydraulic unit 72 with at least one impeller 73 for rotating about an axial direction, a pump shaft 74 connecting the drive 71 unit with the at least one impeller 73. In this example, the drive unit comprises a drive unit shaft 113, which is connected to the pump shaft 74 via a shaft coupling 112. In addition, the embodiment shown in FIG. 6 comprises a detuning device 75, wherein the detuning device is fixedly connected to the vertical pump assembly and wherein the detuning device 75 comprises a detuning ring 1. Preferably, the detuning ring 1 is arranged to surround the pump shaft 74 or the drive unit shaft 113.

The detuning ring 1 or the detuning device 75, respectively, is preferably arranged with respect to the axial direction between two components 90, 91 of the vertical pump 7. As an example, FIG. 7 shows an arrangement of the detuning ring 1 between the two components 90, 91 of the vertical pump assembly 7, which is for example configured as shown in FIG. 6.

Figure 7:
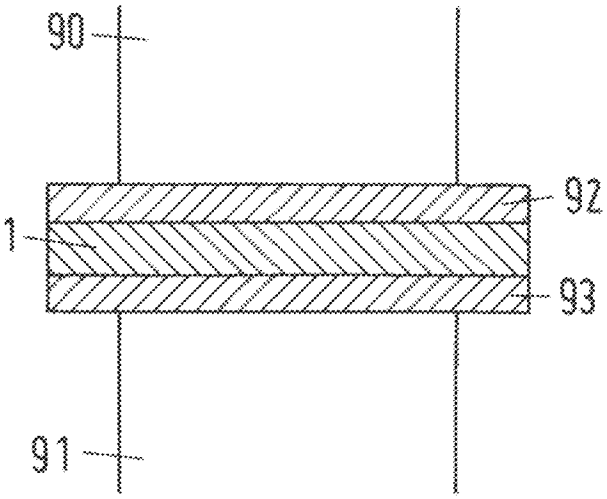
FIG. 7 is a schematic illustration of an arrangement of a detuning ring according to the disclosure between two component flanges.

The components 90, 91 of the pump assembly 7 comprise, as illustrated in FIG. 7, a flange 92 and a flange 93 which are arranged axially adjacent to each other, so that the two components 90 and 91 can be connected using the flanges 92 and 93. In this example, the detuning ring 1 is arranged between the flange 92 and the flange 93. While no size restrictions of components 90 or 91, or their corresponding flanges 92 and 93, or the detuning ring 1 exist, it is a preferred configuration that the outer diameter of the detuning ring 1 approximately matches the outer diameter of the adjacent flanges 92 and 93.

FIG. 6 shows a preferred arrangement of the detuning ring 1 within the vertical pump assembly 7 between the drive unit 71 and the hydraulic unit 72. If, as in FIG. 6, the vertical pump assembly 7 comprises an intermediate unit 111, which is arranged between the drive unit 71 and the hydraulic unit 72 for providing space for additional components such as a shaft coupling 112, a preferred configuration is that the detuning ring 1 is arranged between the intermediate unit 111 and the hydraulic unit 72. Another even more preferred configuration is that the detuning ring 1 is arranged between the drive unit 71 and the intermediate unit 111.

Figure 8:
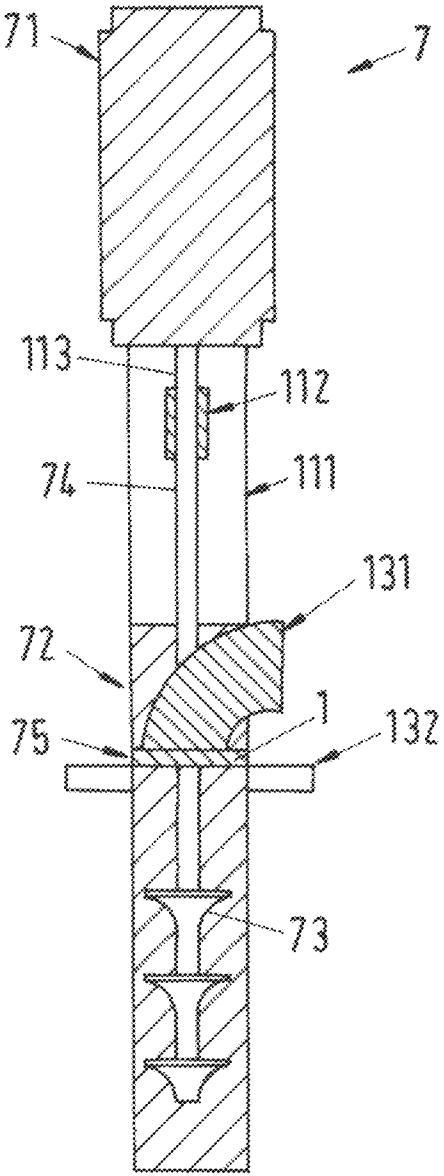
FIG. 8 is a schematic illustration of a second embodiment of a vertical pump assembly according to the disclosure.

FIG. 8 shows a second embodiment of the vertical pump assembly 7, which further comprises a discharge-head 131 wherein the hydraulic unit 72 is in fluid communication with the discharge-head 131, which is arranged between the drive unit 71 and the hydraulic unit 72 and configured to be mounted to a base plate 132. In this configuration, the detuning ring 1 is arranged between the discharge-head 131 and the base plate 132. It must be noted that any other arrangement of the detuning ring 1 within the pump assembly 7, such as described for FIG. 6 and FIG. 7, is possible for the second embodiment of the vertical pump assembly 7 shown in FIG. 8 as well.

Figure 9:
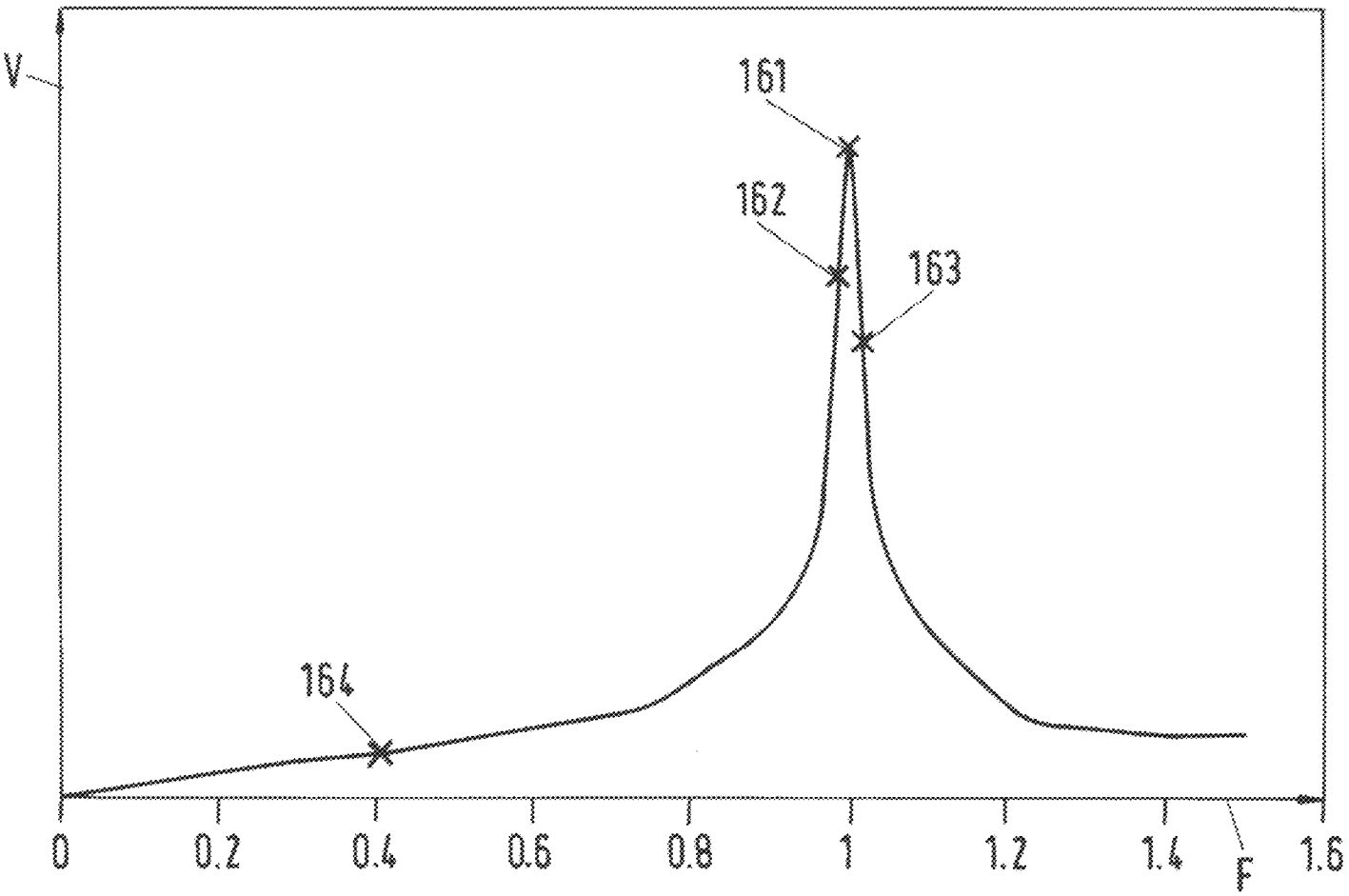
FIG. 9 is the vibration amplitude of an embodiment of a vertical pump assembly as a function of the ratio between natural frequency and excitation frequency.

FIG. 9 shows the measured normalized vibration amplitude V of a test system, comprising a typical embodiment of a vertical pump assembly without a detuning device, as a function of the ratio between natural frequency and excitation frequency F. To obtain these results, a vertical pump assembly without detuning device and equipped with a variable frequency drive was operated at different speeds to sweep through the relevant excitation frequency regime, while measuring the vibration response. The maximum vibration amplitude is reached at the full resonance condition 161, where the excitation frequency equals the natural frequency of the tested system. Further, two near resonance conditions are highlighted, wherein the first near resonance condition 162 represents a typical condition where the excitation frequency is higher than the natural frequency, and the second near resonance condition 163 represents a typical condition, where the excitation frequency is lower than the natural frequency. The operating conditions 161, 162, and 163 represent a worst-case approximation of the excitation response, i.e., the vibration behavior of a vertical pump assembly. When the test system is equipped with a detuning ring according to the disclosure, and excitation as in the worst-case operating conditions 161, 162, and 163, leads to a significantly reduced vibration amplitude, as indicated by the numeral 164, which clearly highlights the effectiveness of the detuning ring according to the disclosure.

What is claimed:

1. A detuning ring for detuning a structural resonance in a pump assembly, the pump assembly including a drive unit and a hydraulic unit, the detuning ring comprising:

a first axial face; and a second axial face, the first axial face including a plurality of first lands and a plurality of first grooves, each first land of the plurality of first lands extending in a radial direction and comprising a planar first top face, and each first groove of the plurality of first grooves delimited by two adjacent first lands of the plurality of first lands and the first axial face, the second axial face including a plurality of second lands and a plurality of second grooves, each second land of the plurality of second lands extending in the radial direction and comprising a planar second top face, each second groove of the plurality of second grooves delimited by two adjacent second lands of the plurality of second lands and the second axial face, the detuning ring is a single structural element that includes the first axial face and the second axial face and is configured to be arranged between the drive unit and the hydraulic unit, and to be fixed relative to the drive unit or the hydraulic unit.

2. The detuning ring in accordance with claim 1, wherein the plurality of first grooves and the plurality of second grooves are arranged such that each first groove of the plurality of first grooves overlaps with two adjacent second grooves of the plurality of second grooves in a circumferential direction.

3. The detuning ring in accordance with claim 1, wherein at least one of the plurality of first lands or at least one of the plurality of second lands includes an axially extending through hole or tapped hole to receive a fixing element, the through hole or tapped hole extending from the first top planar face or the second top planar face of the least one of the plurality of first lands or the at least one of the plurality of second lands.

4. The detuning ring in accordance with claim 1, further comprising at least two separate segments, abutting in a circumferential direction.

5. The detuning ring in accordance with claim 1, wherein the first plurality of grooves or the second plurality of grooves is closed in an axial direction to form a plurality of slots.

6. The detuning ring in accordance with claim 5, wherein at least one slot of the plurality of slots or at least one groove of the plurality of grooves is filled with a vibration absorbing material.

7. A vertical pump assembly comprising:

the drive unit;

the hydraulic unit with at least one impeller for rotating about an axial direction;

a shaft connecting the drive unit with the at least one impeller; and a detuning device fixedly connected to the vertical pump assembly, the detuning device comprising the detuning ring in accordance with claim 1, the detuning ring arranged to surround the shaft.

8. The vertical pump assembly in accordance with claim 7, wherein the detuning ring is arranged between two flanges, which are arranged axially adjacent to each other.

9. The vertical pump assembly in accordance with claim 8, wherein an outer diameter of the detuning ring approximately matches an outer diameter of the two flanges.

10. The vertical pump assembly in accordance with claim 7, wherein the detuning ring is arranged between the drive unit and the hydraulic unit.

11. The vertical pump assembly in accordance with claim 7, wherein the intermediate unit is arranged between the drive unit and the hydraulic unit to provide space for additional components and structural stability, and the detuning ring arranged between the drive unit and the intermediate unit.

12. The vertical pump assembly in accordance with claim 7, wherein an intermediate unit is arranged between the drive unit and the hydraulic unit provide space for additional components and structural stability, and the detuning ring is arranged between the intermediate unit and the hydraulic unit.

13. The vertical pump assembly in accordance with claim 7, wherein the hydraulic unit is in fluid communication with a discharge-head arranged between the drive unit and the hydraulic unit and configured to be mounted to a base plate, and the detuning ring is arranged between the discharge-head and the base plate.

14. A method for shifting a natural frequency of a vertical pump assembly including the drive unit, the hydraulic unit with at least one impeller for rotating about an axial direction, and a shaft connecting the drive unit with the at least one impeller, the method comprising: arranging the detuning ring in accordance with claim 1 between the drive unit and the hydraulic unit.

15. The method in accordance with claim 14, further comprising arranging vibration absorbing material within at least one slot or one groove of the plurality of grooves of the detuning ring.

* * * * *